US006830362B2

(12) United States Patent
Mullen

(10) Patent No.: US 6,830,362 B2
(45) Date of Patent: Dec. 14, 2004

(54) ATTACHMENT FOR RETAINING LENSES ON A REFLECTOR LAMP

(76) Inventor: Nate Mullen, 1240 Simpson Way, Escondido, CA (US) 92029

( * ) Notice: Subject to any disclaimer, the term of this patent is extended or adjusted under 35 U.S.C. 154(b) by 0 days.

(21) Appl. No.: 10/121,506

(22) Filed: Apr. 11, 2002

(65) Prior Publication Data

US 2003/0193811 A1 Oct. 16, 2003

(51) Int. Cl.[7] ..... F21V 17/00
(52) U.S. Cl. ..... 362/455; 362/457
(58) Field of Search ..... 362/310, 311, 362/288, 293, 455, 417, 426, 457

(56) References Cited

U.S. PATENT DOCUMENTS

| | | | |
|---|---|---|---|
| 1,625,693 | A | 4/1927 | Vest |
| 2,499,555 | A | 3/1950 | Wronkowski |
| 2,785,291 | A | 3/1957 | Bernstein |
| 3,696,238 | A | 10/1972 | Szymanski |
| 5,176,441 | A | 1/1993 | Horvath Vegh |
| 5,921,662 | A | 7/1999 | Bruckner et al. |

*Primary Examiner*—Stephen F Husar
(74) *Attorney, Agent, or Firm*—Joseph A. Yanny; MichaelA. DiNardo

(57) ABSTRACT

The present invention relates to a lens retaining clip designed to hold a lens in place in the light path of a light bulb. This invention has two preferred embodiments designed to work with either an MR-16 light bulb or a PAR-36 light bulb. The primary difference between the embodiments is the shape and function of the retaining arms spaced around the perimeter of the retaining clip. Each embodiment of the present invention comprises a generally circular main bracket, and one or more, preferably three equally spaced, retaining arms. The main bracket is narrow in relation to the total diameter of the top member so as not to obstruct the light path of the light bulb. Retaining arms are attached to the outer edge of the main bracket and each are designed with an indented portion designed to "clip" onto the light bulb and retain the lens retaining clip on the bulb. In operation, the lens retaining clip secures a lens of generally the same shape and size as the lens retaining clip against a light bulb.

It is desirable for the lens retaining clip to be made from a resilient material. The resilient material allows the lens retaining clip to flex outward around the edge of the light bulb and return to its original shape once in place. The return action of the lens retaining clip is the force that holds the lens retaining clip on the light bulb. The resilient material can include plastic, rubber and metal.

20 Claims, 4 Drawing Sheets

ATTACHMENT FOR RETAINING LENSES ON A REFLECTOR LAMP

FIELD OF THE INVENTION

The present invention relates to attachments for lamps with reflector envelopes (reflector lamps). More specifically, the present invention relates to an attachment for retaining one or more lenses in position for the use with a reflector lamp. In addition, the present invention relates to attachments for reflector lamps that may be used or are used in conjunction with existing light fixtures. Furthermore, the present invention has at least two preferred embodiments, whereby each embodiment is to be used with one of two types of reflector lamps.

BACKGROUND OF THE INVENTION

Generally, U.S. Pat. No. 5,921,662 ('662) discloses an attachment consisting of a plurality of vanes, among other things, for deflecting light from lamps with reflector envelopes. More specifically, the '662 patent discloses a lamp assembly that comprises a lamp with reflector envelopes (reflector lamp) and a one-piece integral attachment upon the reflector lamp. In addition, '662 discloses that the one-piece integral attachment comprises a plurality of vanes for deflecting light that is produced from the reflector lamp, a means for interconnecting the plurality of vanes into one piece upon a rim of the reflector lamp, and holding members formed on the one piece that engage the reflector lamp behind the rim. The '662 patent does not disclose an attachment for retaining a separate lens, color filter, or light louver for use with the reflector lamp.

U.S. Pat. No. 2,785,291 ('291) generally discloses a two-piece attachment for a reflector lamp for mounting a color lens or light louver for use with a reflector lamp. More specifically, the '291 patent discloses a device that comprises, among other things, a hollow cylindrical member, spring clips, and an adapted member. The spring clips of the '291 patent are secured to the inner surface of the hollow cylindrical member and provide for the removable attachment of the hollow cylindrical member to the reflector lamp. Further, the spring clips of the '291 patent are formed of a flat strip of spring metal, and are provided with a generally V-shaped portion. The '291 patent discloses that the attached member is release ably secured to the hollow cylindrical member, with a color lens or light louver placed in between the hollow cylindrical member and the adapted member.

The '291 patent does not disclose a one-piece attachment for retaining a lens for use with a reflector lamp. Further, the two-piece device disclosed in the '291 patent provides for a relatively bulky device. As a result, the '291 device is undesirable to those of ordinary skill in the prior art for at least two reasons. First, the '291 two-piece device may be too bulky to be compatible with or used easily with many modern light fixtures. Second, the '291 patent does not provide for a low profile attachment for retaining a lens for use with a reflector lamp.

Other types of prior art devices in general have the lens retaining device as part of the overall light fixture, and not as an attachment to a reflector lamp. One disadvantage of this type of prior art device is that it does not allow for easy replacement of the lenses. More specifically, a user often needs to disassemble the fixture or lens retaining portion of the fixture in order to change a lens. Another disadvantage of this type of prior art devices is that the lens retaining portion of one prior art light fixture is not interchangeable with other prior art devices.

ADVANTAGES OF THE INVENTION

One advantage of the present invention is that it provides an attachment for retaining one or more lenses for use with a lamp with a reflector envelope (reflector lamp) that is easy to install on the reflector lamp.

Another advantage of the present invention is that it provides an attachment for retaining one or more lenses for use with a reflector lamp such that replacing a reflector lamp with a reflector lamp and attachment is approximately as easy as changing a light bulb.

Another advantage of the present invention is that it provides an attachment for retaining one or more lenses for use with a reflector lamp which attachment has a low profile when installed on a reflector lamp.

Another advantage of the invention is that it provides an attachment for retaining one or more lenses for use with a reflector lamp which attachment will function in most existing prior art light fixtures without modification of the light fixture.

BRIEF SUMMARY OF THE INVENTION

Reflector lamps, also known in the art as miniature reflectors, general diffuse reflectors, or lamps with reflector envelopes, are commonly used for home and commercial lighting applications. The attachment of the present invention is generally described by two preferred embodiments. The first preferred embodiment shown generally in FIGS. 1A–1C of the present invention is directed to an attachment for retaining lenses for use generally with an MR-16 reflector lamp. The second preferred embodiment shown generally in FIGS. 3A–3D of the present invention is directed to an attachment for retaining lenses for use generally with a PAR-36 bulb. The preferred embodiments of the attachment are both comprised of, among other things, a main bracket and a plurality of retaining arms. The primary difference between the embodiments, as described below is the shape and function of retaining arms spaced around the perimeter of the attachment.

Each of the preferred embodiments of the present invention comprises a generally circular main bracket, and one or more retaining arms. The generally circular main bracket is narrow in relation to the total diameter of the lens retaining clip. The main bracket is generally open and unobstructed such that, when the attachment is applied to a light source, it substantially allows the passage of light through or around the main bracket. In each of the preferred embodiments, the retaining arms are attached to the edge of the main bracket and are generally perpendicular to the main bracket.

In the first preferred embodiment, the retaining arms have a first portion, a second portion, and a return portion. The first portion is attached to the edge of the main bracket and is generally perpendicular to the main bracket. The second portion is attached to the first portion and is directed generally toward the center axis of the main bracket. The return portion is attached to the second portion and is directed generally away from the center axis of the main bracket.

In the second preferred embodiment, the retaining arms are generally similar to those of the first preferred embodiment, however, the retaining arms in the second preferred embodiment have a dimple on the first portion of each retaining arm, and a plateau portion between the second portion and the return portion. The dimples collectively form a structure that supports one or more lenses. The plateau portions substantially contact a rim portion of the PAR-36 reflector lamp.

The return/plateau portion of each of the retaining arms is designed to "clip" onto a reflector lamp and retain the lens retaining clip on the lamp. In each preferred embodiment, the lens retaining clip includes three retaining arms equally spaced around the perimeter of the main bracket. In operation, the lens retaining clip secures a lens of generally the same shape and size as the lens retaining clip against a light bulb.

It is generally desirable for the lens retaining clip to be made from a resilient material. The resilient material allows the lens retaining clip to flex outward around the edge of the light bulb and return to its original shape once in place. The return action of the lens retaining clip is the force that holds the lens retaining clip on the light bulb. The resilient material may include, for example, plastic, rubber and metal.

In operation, the attachment may retain a lens, a color filter, or a louvered grate generally in place between the reflector lamp and the attachment. The attachment is set generally upon the reflector lamp, such that the retaining arms come in contact with the reflector lamp. The attachment and the retaining lamp are generally forced together, and the retaining arms are forced outward from the center axis of the main lens ring by the reflector lamp. The retaining arms generally contact the outside surface of the reflector lamp. The above described operation may be substantially reversed in order to remove the attachment from the reflector lamp.

DETAILED DESCRIPTION OF THE INVENTION

Figure 1A:
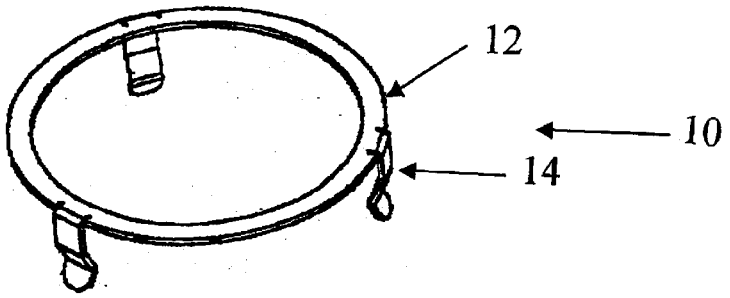
FIG. 1A shows a perspective view of the first preferred embodiment of the inventive attachment in use on an MR-16 light bulb.

Reflector lamps, also known in the art as miniature reflectors, general diffuse reflectors, or lamps with reflector envelopes, are commonly used for home and commercial lighting applications. As shown in FIGS. 2A–2B, a reflector lamp (50) has a parabolic reflector portion (52) and a rim (54). The first preferred embodiment shown generally in FIGS. 1A–1C of the present invention is directed to an attachment (10) for retaining a lens for use with a reflector lamp. More specifically, the first preferred embodiment is directed to an attachment (10) for retaining a lens for use with an MR-16 reflector lamp (50). However, the scope of the present invention is directed generally toward reflector lamps, as a skilled artisan would know that the present invention may be directed toward reflector lamps other than the MR-16 type. The first preferred embodiment of the attachment (10) comprises, among other things, a main bracket (12) and a plurality of retaining arms (14).

Generally, it is desirable for the attachment (10), including the main bracket (12) and the retaining arms (14) to be made from one or more resilient materials, such as aluminum, other metals, rubber, or plastic. However, the attachment (10) including the main bracket (12) and the retaining arms (14) may be made of other resilient materials without departing from the scope of the present invention. The skilled artisan will recognize the resilient materials that are commonly used in lighting accessories. Furthermore, the skilled artisan will recognize that the resiliency properties of the these materials will vary among the different materials.

The main bracket (12) is a structure that is generally open and unobstructed such that when the attachment (10) is applied to a light source, it substantially allows the passage of light through or around the main bracket (12). More specifically, the main bracket (12) of the preferred embodiment is a substantially planar circular structure that defines a void. In addition, the main bracket (12) has one or more retaining arms (14) connected to its outer edge. The main bracket (12) of alternative embodiments may be substantially planar structures that define a void that have shapes other than circular. In further alternative embodiments, the main bracket (12) may have structures other than a substantially planar structure defining a void without departing from the scope of the present invention. In further alternative embodiments, the main bracket (12) may be made out of a material that is substantially transparent.

Figure 1B:
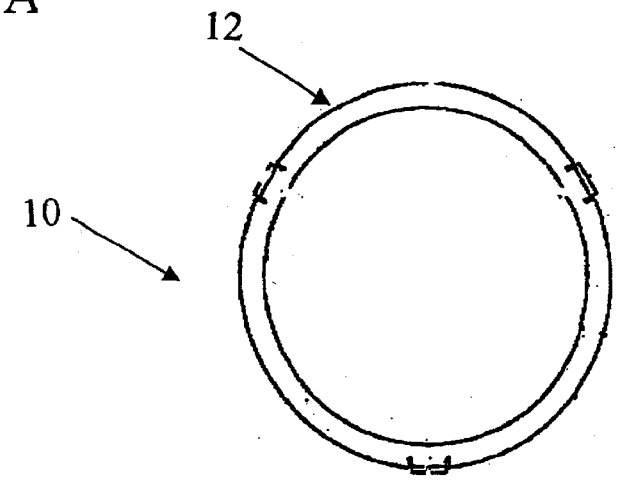
FIG. 1B shows a side view of the first preferred embodiment of the inventive attachment in use on an MR-16 light bulb.
Figure 1C:
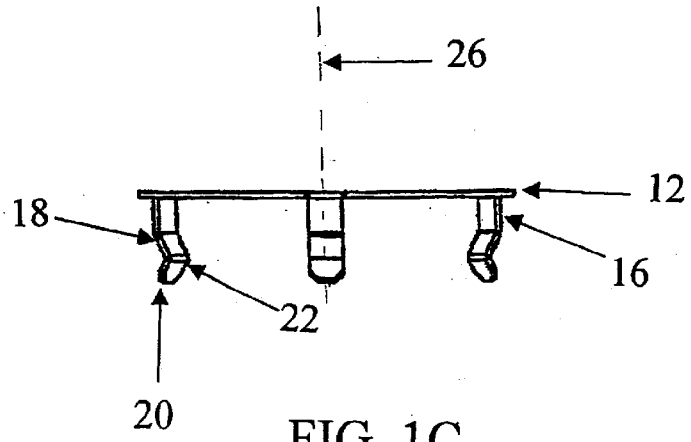
FIG. 1C shows a perspective view of the first preferred embodiment of the inventive attachment.
Figure 2A:
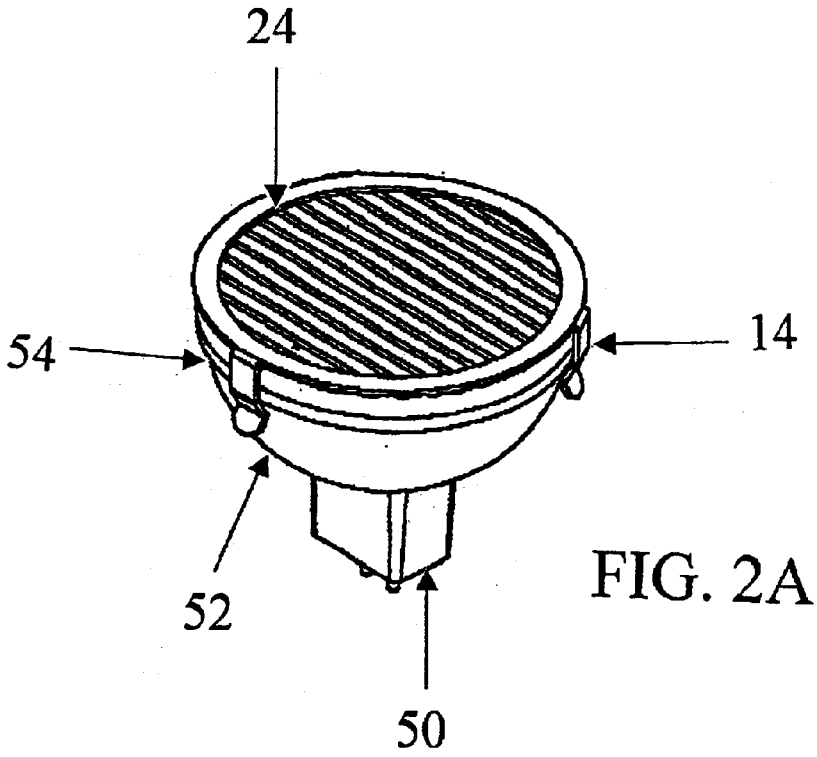
FIG. 2A shows a top view of the first preferred embodiment of the inventive attachment.
Figure 2B:
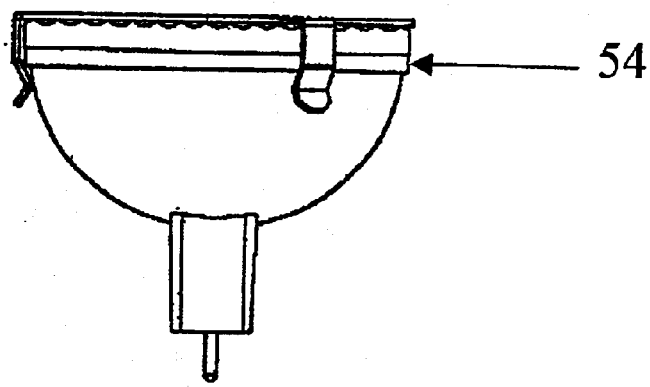
FIG. 2B shows a side view of the first preferred embodiment of the inventive attachment.

As shown in FIGS. 1A–1C, the retaining arms (14) have a first portion (16), a second portion (18), and a return portion (20). The preferred embodiment of attachment (10) has three retaining arms (14). However, a skilled artisan will appreciate that fewer retaining arms (14) may be used without departing from the scope of the present invention. The first portion (16) is attached to the main bracket (12). The second portion (18) is attached to the first portion (16) and is directed generally toward the center axis (depicted as element 19 in FIG. 1C) of the main bracket (12). The return portion (20) is attached to the second portion (18) and is directed generally away from the center axis (19) of the main bracket (12). The point at which the second portion (18) and return portion (20) are joined is the retaining arm point (22). The retaining arms (14) may be constructed out of one or more materials such as steel, aluminum, rubber, or plastic. However, a skilled artisan would know that the retaining arms (14) may be made of other materials without departing from the scope of the present invention. In addition, each of the retaining arms (14) have a generally flexible characteristic to allow for relative movement of the retaining arms (14) both inwardly and outwardly, as substantially described below.

In operation of the attachment (10), a lens, color filter, or louvered grate (24) may be placed generally in between the reflector lamp (50) and the attachment (10). Preferably, the lens, color filter or louvered grate (24) is approximately the same size and shape as the face of the reflector lamp (50). The attachment (10) is set generally upon the reflector lamp (50), such that the retaining arms (14) come in contact with the rim (54) of the reflector lamp (50). The attachment (10) and the retaining lamp (50) are generally forced together, and the retaining arms (14) are forced outward from the center axis (19) of the main bracket (12) by the rim (54) of the reflector lamp (50). The retaining arms (14) generally contact the outside surface (52) of the reflector lamp (50). In the first preferred embodiment, the retaining arm points (22) generally contact the reflector lamp (50) at a location that is generally below the rim (54) of the reflector lamp (50).

The skilled artisan will appreciate that the retaining arms (14) do not need to generally contact the reflector lamp (50) at a location below the rim (54) of the reflector lamp (50). In addition, the skilled artisan will recognize that the retaining arms (14) do not all need to be in direct contact the reflector lamp (50). Rather, the skilled artisan will understand that the retaining arms (14) may be generally contacting the outer surface (52) of the reflector lamp (50). The above described operation may be substantially reversed in order to remove the attachment (10) from the reflector lamp (50).

Figure 3A:
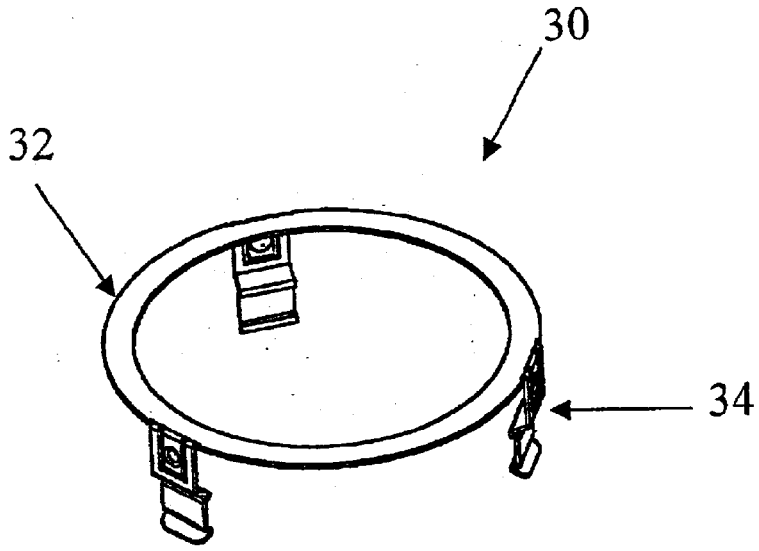
FIG. 3A shows a perspective view of the second preferred embodiment of the inventive attachment.
Figure 3B:
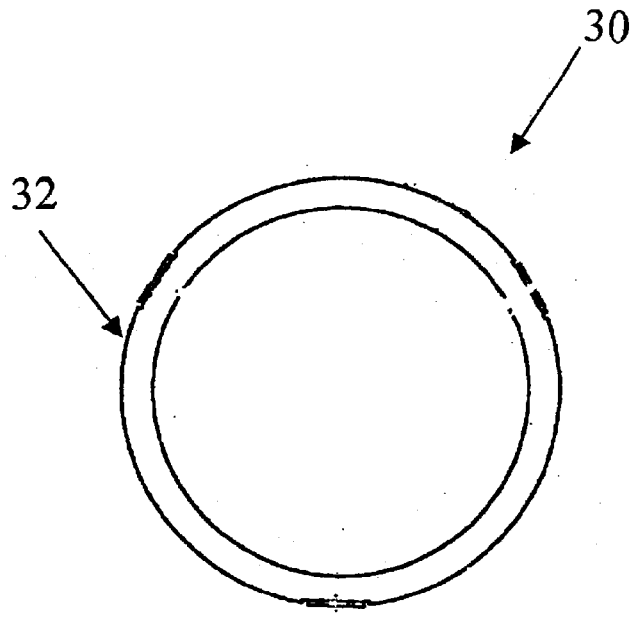
FIG. 3B shows a top view of the second preferred embodiment of the inventive attachment.
Figure 3C:
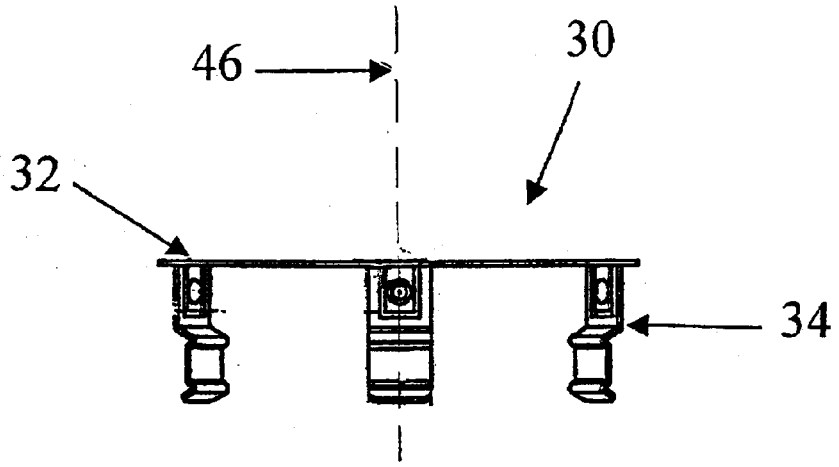
FIG. 3C shows a side view of the second preferred embodiment of the inventive attachment.
Figure 3D:
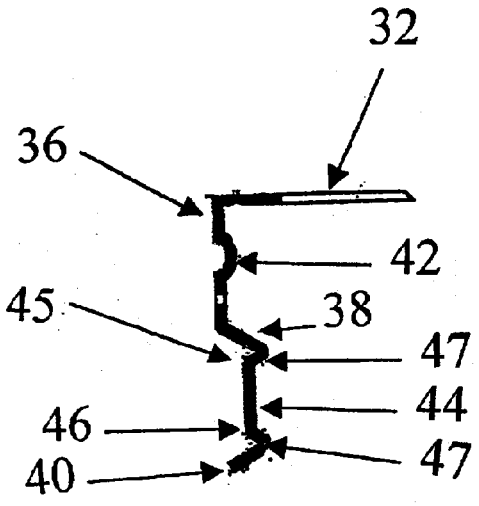
FIG. 3D shows a close-up side view of one of the retaining arms on the second preferred embodiment of the inventive attachment.

The second preferred embodiment is directed toward an attachment (30) for use with a PAR-36 reflector lamp (not shown). However, a skilled artisan will recognize that the attachment (30) of the second preferred embodiment may function with other types of reflector lamps as well. The second preferred embodiment, shown in FIGS. 3A, 3B, and 3C, has a similar structure and operation as the first preferred embodiment, with the exception of at least two differences that will be explained below. Like the first preferred embodiment, the attachment (30) of the second preferred embodiment comprises, among other things, a main bracket (32) and a plurality of retaining arms (34). Also like the first preferred embodiment, the retaining arms (34), shown with greater detail in FIG. 3D, generally have a first portion (36), a second portion (38), and a return portion (40).

One difference in the second preferred embodiment is that there is an indented portion (42) on the first portion (36) of each of the retaining arms (34). The indented portions (42) are members that are generally directed toward the center axis (depicted as element 46 in FIG. 3C) of the main bracket (32). Together, the indented portions (42) form a plurality of members upon which a lens (not depicted for this embodiment) may be supported.

Another difference in the second preferred embodiment is the existence of a plateau portion (44) between the second portion (38) and the return portion (40). The plateau portion (44) generally contacts a rim of the reflector lamp (not depicted for this embodiment), and has a first end (45) and a second end (46). Further, the plateau portion (44) preferably has a ridge portion (47) at both the first end (45) and the second end (46).

As with the first embodiment, in operation of the attachment (30) of the second preferred embodiment, a lens, color filter, or louvered grate (not depicted) may be placed generally in the attachment (30) between the collective indented portions (42) of the retaining arms (34). Preferably, the lens, color filter or louvered grate (not depicted) is approximately the same size and shape as the main bracket (32) of the attachment (30). The attachment (30) is set generally upon the reflector lamp, such that the retaining arms (34) come into contact with the reflector lamp. The attachment (30) and the retaining lamp are generally forced together, and the retaining arms (34) are forced outward from the center axis (46) of the main bracket (32) by the rim of the reflector lamp. The retaining arms (34) generally contact the outside surface of the rim of the reflector lamp. In the second preferred embodiment, the retaining arm plateau portions (44) contact the reflector lamp generally at the rim of the reflector lamp. However, the skilled artisan will appreciate that the retaining arms (34) or the plateau portions (44) do not need to contact the reflector lamp generally at the rim of the reflector lamp. In addition, the skilled artisan will recognize that the retaining arms (34) do not all need to be in direct contact with the reflector lamp. Rather, the skilled artisan will understand that the retaining arms (34) may be generally contacting the outside surface of the reflector lamp. The above described operation may be substantially reversed in order to remove the attachment (30) from the reflector lamp.

The above-described preferred embodiments are intended to illustrate the principles of the invention, but not to limit its scope. Other embodiments and variations of these preferred embodiments will be apparent to one of ordinary skill in the art and may be made without departing from the spirit and scope of the invention as defined in the following claims.

I claim:

1. An attachment for a reflector lamp, comprising:
a main bracket further having a center axis; and
two or more retaining arms;
wherein one of said two or more retaining arms further comprise:
a first portion connected to said main bracket;
wherein said main bracket is constructed out of a substantially transparent material;
a second portion connected to said first portion; and
a return portion connected to said second portion.

2. An attachment for a reflector, lamp comprising:
a main bracket further having a center axis; and
two or more retaining arms;
wherein one of said two or more retaining arms further comprises:
a first portion connected to said main bracket such that said first portion is substantially perpendicular to said main bracket;
wherein said main bracket is constructed out of a substantially transparent material;
a second portion connected to said first portion such that said second portion is substantially directed toward said center axis of said main bracket; and
a return portion connected to said second portion such that said return portion is substantially directed away from said center axis of said main bracket.

3. An attachment for a reflector lamp, comprising:
a main bracket further having a center axis; and
two or more retaining arms;
wherein one of said two or more retaining arms further comprise:
a first portion connected to said main bracket;
a second portion connected to said first portion;
a plateau portion having a first end and a second end;
wherein said first end of said plateau portion is connected to said second portion; and
a return portion;
wherein said return portion is connected to said second end of said plateau portion.

4. The attachment of claim 3, wherein said attachment is constructed of a material selected from the group consisting of metal, rubber, plastic, and resilient wire.

5. The attachment of claim 3, wherein said main bracket substantially defines a void.

6. The attachment of claim 3, wherein said main bracket substantially allows the passage of light through said main bracket.

7. The attachment of claim 3, wherein said main bracket substantially allows the passage of light around said main bracket.

8. The attachment of claim 3, wherein said main bracket is constructed out of a substantially transparent material.

9. The attachment of claim 3, wherein said first portion further comprises an indented portion substantially directed toward said center axis of said main bracket.

10. The attachment of claim 3, wherein said first portion is connected to said main bracket such that said first portion is substantially perpendicular to said main bracket.

11. The attachment of claim 3, wherein said second portion is connected to said first portion such that said second portion is substantially directed toward said center axis of said main bracket.

12. The attachment of claim 3, wherein said plateau portion is connected to said second portion such that said return portion is substantially parallel with said center axis of said main bracket.

13. The attachment of claim 3, wherein said plateau portion further comprises a ridge portion at one of said first end and said second end of said plateau portion.

14. The attachment of claim 3, wherein said return portion is connected to said plateau portion such that said return portion is substantially directed away from said center axis of said main bracket.

15. An attachment for a reflector lamp, comprising:

a main bracket further having a center axis; and two or more retaining arms;

wherein one of said two or more retaining arms further comprise:

a first portion connected to said main bracket such that said first portion is substantially perpendicular to said main bracket, a second portion connected to said first portion such that said second portion is substantially directed toward said center axis of said main bracket;

a plateau portion connected to said second portion such that said plateau portion is substantially parallel to said center axis of said main bracket; said plateau portion further comprising:

a first end;

a second end;

a ridge portion at one of said first end and second end; and a return portion connected to said second end such that said return portion is substantially directed away from said center axis of said main bracket.

16. The attachment of claim 15, wherein said attachment is constructed of a material selected from the group consisting of metal, rubber, plastic, and resilient wire.

17. The attachment of claim 15, wherein said main bracket substantially defines a void.

18. The attachment of claim 15, wherein said main bracket substantially allows the passage of light through said main bracket.

19. The attachment of claim 15, wherein said main bracket substantially allows the passage of light around said main bracket.

20. The attachment of claim 15, wherein said main bracket is constructed out of a substantially transparent material.

* * * * *